United States Patent [19]

Turek et al.

[11] Patent Number: 4,459,098

[45] Date of Patent: Jul. 10, 1984

[54] METHOD AND APPARATUS FOR CONTROLLING SECONDARY AIR DISTRIBUTION TO A MULTIPLE FUEL COMBUSTOR

[75] Inventors: David G. Turek, Manchester; Stanley R. Wysk, Suffield, both of Conn.

[73] Assignee: Combustion Engineering, Inc., Windsor, Conn.

[21] Appl. No.: 401,586

[22] Filed: Jul. 26, 1982

[51] Int. Cl.[3] ..... F23N 5/00

[52] U.S. Cl. ..... 431/12; 431/90; 364/502; 364/510; 137/6; 110/188; 110/348

[58] Field of Search ..... 431/12, 89, 90; 137/6; 236/15 BD, 14; 364/500, 501, 502, 510; 422/109, 110; 250/358.1, 359.1, 390, 255; 110/188, 348

[56] References Cited

U.S. PATENT DOCUMENTS 3,722,811 3/1973 Osburn ..... 236/14
4,115,862 9/1978 Stewart ..... 364/500
4,138,725 2/1979 Ikemoto et al. ..... 364/502
4,266,132 5/1981 Marshall ..... 250/359.1

OTHER PUBLICATIONS

Jul./Aug. 1980-*Reading The Composition of Coal*—Electric Power Research Institute—EPRI Journal.

*Primary Examiner*—Lee E. Barrett
*Attorney, Agent, or Firm*—Troxell K. Snyder

[57] ABSTRACT

Method and apparatus for controlling the distribution of secondary air (30) between at least two fuel burners (14,16) in a multiple fuel combustor (16). Total chemical energies of the individual fuel streams (44,60) are determined and compared (64,66) with the total combustor chemical energy input (62) for controlling biasing means (32,34). The determination of at least one individual fuel total chemical energy content (60) may optionally include a prompt neutron activation type analyzer (48) for on-line measurement of specific fuel chemical energy (59).

12 Claims, 2 Drawing Figures

METHOD AND APPARATUS FOR CONTROLLING SECONDARY AIR DISTRIBUTION TO A MULTIPLE FUEL COMBUSTOR

BACKGROUND OF THE INVENTION

1. Field of the Invention

This invention pertains to a method and apparatus for controlling the distribution of secondary air between different fuel streams of a multiple fuel combustor.

2. Description of the Prior Art

The majority of fuel combustors in use today are designed to completely oxidize a single fuel in a complete and efficient manner. The total flow of air for oxidation to the combustor is regulated based on the oxygen content of the flue gas exiting the combustor. Air flows to a combustor in two streams, a primary air stream and a secondary air stream. The primary air stream, particularly in the application in which a granulated solid fuel is combusted in suspension within the combustor, is used to convey the fuel into the combustor. As a result, the flow characteristics of the primary air stream are dictated by the requirements of the fuel feed to the combustor. In a pulverized coal fired combustor the primary air stream will not supply adequate combustion air for complete coal burnout, thus a secondary air stream is required.

The secondary air stream is typically admitted at or nearby the fuel injecting burners in the combustor. The secondary air stream provides the balance of the combustion air necessary to adequately react the fuel in the combustor. It should be noted that in those combustors in which a primary air stream is not required, for example oil or natural gas fired applications, the balance of the combustion air is still termed the secondary air stream despite the fact that no primary air stream is present.

In recent years it has become advantageous to design and build combustors which have the capability of firing a variety of fuels. This makes possible the use of an alternative fuel should the design fuel be unavailable or unattractively priced. Typically this has been accomplished by equipping the combustor with two sets of burners, one for each type of fuel. During those periods when both sets of burners are in use, the distribution of the secondary air between each set of burners must be controlled so as to insure proper burnout of the fuels. Current practice in this regard involves manually fixing the distribution of secondary air between the burner sets based on expected firing rates and fuel types.

This method in the prior art of controlling secondary air distribution is unsuitable for use in applications in which at least one of fuels may have an unpredicably varying chemical energy content. As a result of this variation, the amount of air required to adequately react this fuel will also vary, thus resulting in an improper balance of secondary air distribution between the different fuel burner sets.

Typical applications in which a varying fuel stream may be present include the firing of wood chips or manufactured gas in conjunction with a fuel of more stable composition such as oil, natural gas or coal. Another potential application would be in the combustor section of a coal gasifier in which recycled char particles and fresh coal are fired sumultaneously to generate heat for driving the gasification process.

The recycled char in a coal gasifier is composed of unreacted carbon from the gasification reaction and inert ash particles which were originally present in the coal feed. The portion of the char composed of carbon may range from 75% to 0% with the remainder being inert ash. Should the amount of secondary air distributed to the char burners be above (or below) the optimum level, the resulting incorrect char-air mixture could cause unreacted oxygen (or carbon) to be present at the combustor section exit.

Current methods of control used on pilot scale development gasifiers involve manually setting the secondary air flow dampers to distribute the flow of secondary air between the coal and char burners based on the assumed chemical content of the char currently being fed.

In summary, the prior art methods of setting the distribution of secondary air between burner sets in a multiple fuel firing combustor are inadequate when the composition and oxygen requirement of one of the fuels varys unpredictably over time. Operation of a burner set with an excessive or inadequate amount of secondary air will result in inefficient energy utilization and/or incomplete combustion of the fuel.

SUMMARY OF THE PRESENT INVENTION

The present invention provides a method and apparatus for controlling the distribution of secondary air between burner sets in a multiple fuel combustor. According to the present invention the flow rate and composition of at least one of the fuels being fed to the combustor is monitored. Based on this information the balance of secondary air between the respective burner sets is controlled to match the requirements of each fuel.

The monitoring of the fuel composition is performed by an on-line analyzer which provides a continuous readout of the current composition of the varying fuel. The proper distribution of secondary air between the burner sets is thus quickly and automatically adjusted in response to the varying requirements of the input fuels.

DESCRIPTION OF THE PREFERRED EMBODIMENT

Figure 1:
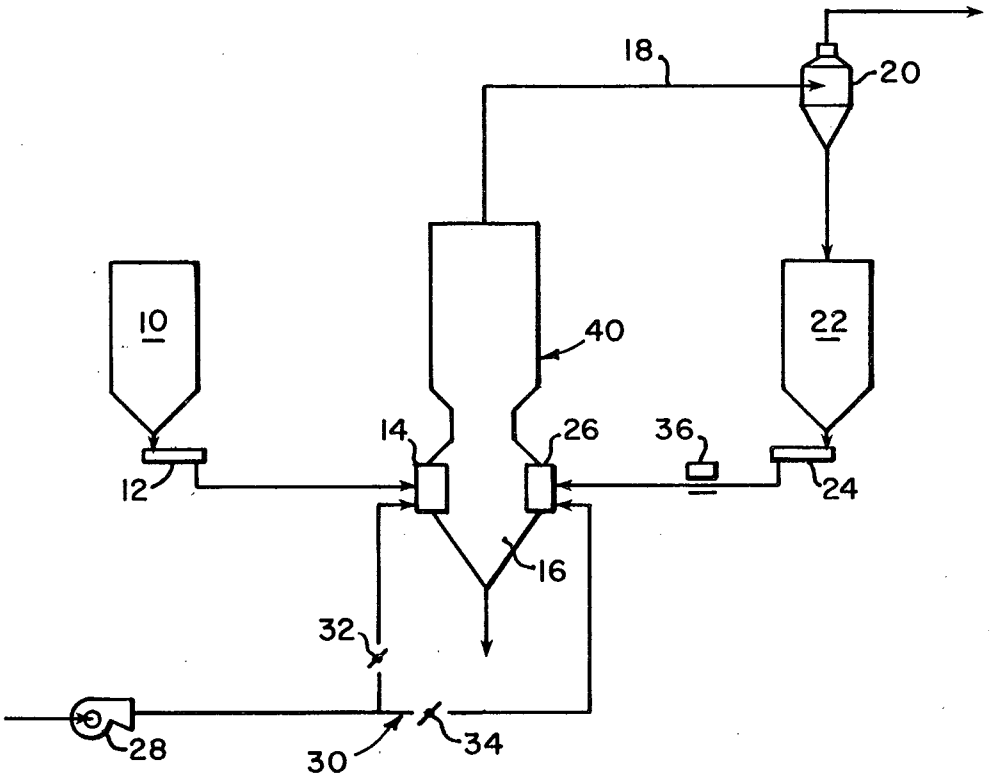
FIG. 1 is a schematic flow diagram of a coal gasification system with char recycle.

FIG.1 shows a coal gasification system in which the present invention is utilized. Coal is fed from a coal supply bin 10 through a coal feeder 12 into the coal burners 14 of the gasifier combustor 16. Char removed from the gasifier exit stream 18 by the cyclone separator 20 is temporarily stored in the char bin 22. This char is recycled back to the combustor 16 by a char feeder 24 and injected by char burners 26. This char may be composed of anywhere from 75% to 0% carbon, with the remaining proportion substantially composed of inert ash particles.

The composition of the char being fed from the char bin at any one particular time is a function of the former operating condition of the gasifier 40 when the char was deposited in the char bin. The time lag between deposition and feeding may vary with the size of the char bin, the amount of char currently stored in the bin, and the firing rate of char in the gasifier.

The source of secondary air is the secondary air fan 28. The secondary air is distributed to the coal and char burners 14,26 by ductwork 30. The distribution of secondary air may be controlled by dampers 32,34 disposed in the ductwork 30.

During operation, coal flow and total secondary air flow will be controlled by the overall gasifier control system (not shown). Char flow will be selected to avoid depleting or overfilling the char bin, thus returning all of the removed char to the gasifier combustor for reaction.

The composition of the char stream is monitored by a char analyzer 36 disposed in the char feed stream between the bin 22 and the char burners 26. Coal and char feed rates are determined by the feeders 12,24.

Figure 2:
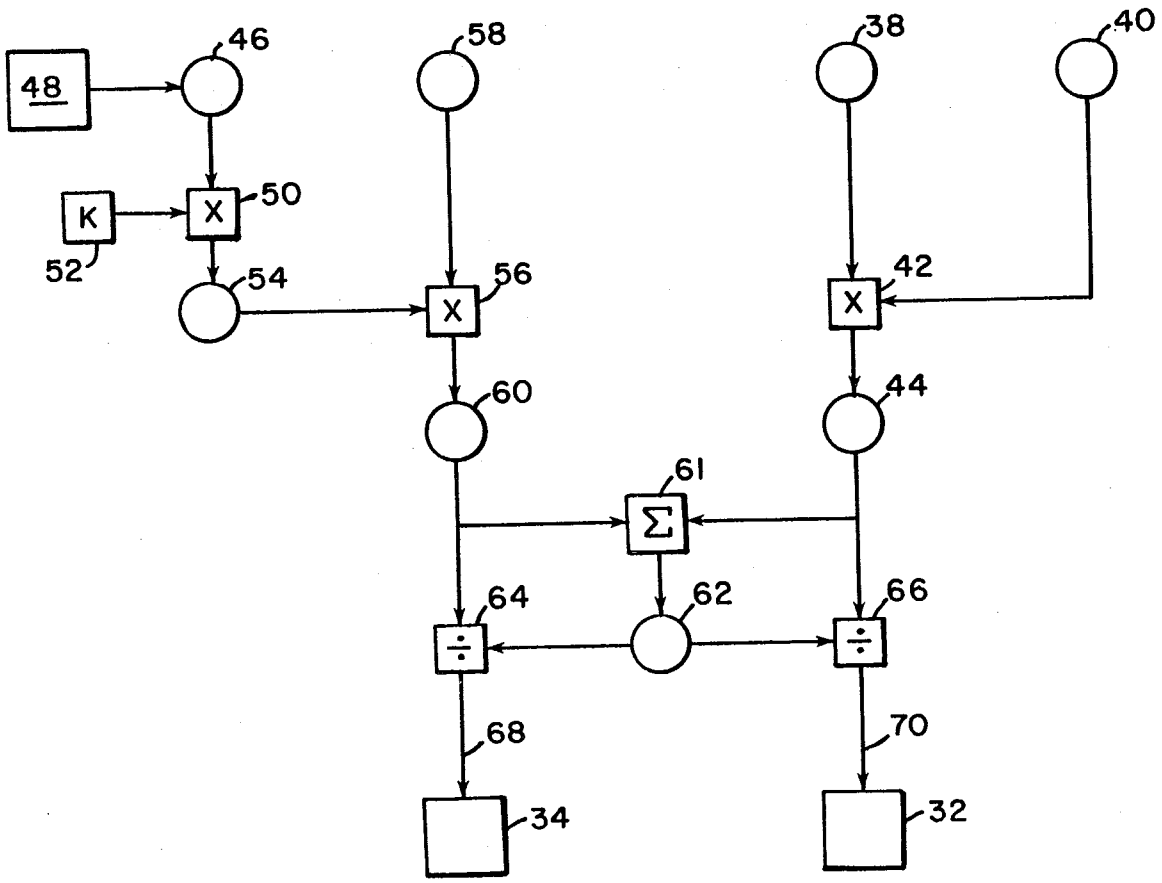
FIG. 2 is a functional block diagram showing the major information and operation blocks.

FIG. 2 shows the apparatus of the present diagram as a number of functional blocks connected as shown. The means for performing these functions will preferably be electronic and may comprise digital or analog elements.

Still referring to FIG. 2, the method for controlling the distribution of secondary air to the multiple fuel combustor of the coal gasifier will be described.

In the preferred embodiment, the rate of coal feed 38 and the coal heating value 40 are multiplied 42 resulting in the coal total energy content 44.

Char carbon content 46 determined by the char analyzer 48 is multilplied 50 by a constant 52 resulting in the char heating value 54. This constant 52 is approximately equal to the higher heating value of pure carbon, 14,093 BTU/lbm (7830 kcal/kg). Multiplying 56 the char heating value 54 by the char feed rate 58 results in the char total chemical energy content 60.

The summation 61 of the total energy contents 44,60 of each fuel results in the total combustor chemical energy input 62. Comparison 64,66 of the total combustor energy input 62 with the individual fuel total chemical energy contents 44,60 results in proportional secondary air control signals 68,70. These signals are used to control the position of the secondary air dampers 32,34.

The distribution of secondary air between the char and coal burners is thus maintained in proportion to the chemical energy content of the respective fuel streams.

The char composition analyzer is a device such as a prompt neutron activation analyzer (PNAA). This device bombards a sample stream of the char fuel with neutrons. As some of these neutrons are captured by nuclei in the sample, gamma rays characteristic of the composition of the fuel sample are sumultaneously emitted. Measurement of the emitted gamma rays results in an on-line measurement of fuel composition.

The present invention may be applied to multiple fuel combustors in which at least one of the entering fuel streams has a varying composition. The use of PNNA technology for measuring fuel composition has been adequately disclosed elsewhere (see for example "Reading the Composition of Coal", EPRI Journal, July/August 1980, pages 7–11).

The present invention is therefore seen to provide a novel means well suited for controlling the distribution of secondary air between respective fuel streams in a multiple fuel combustor.

We claim:

1. An apparatus for controlling the distribution of secondary air between at least two fuel streams entering a combustor, comprising:

means for determining the total chemical energy content of the first fuel stream;

means for determining the total chemical energy content of the second fuel stream;

means for summing the total chemical energy contents of the first and second fuel streams to provide a total combustor energy input;

means, responsive to the first fuel total chemical energy content and the total combustor energy input for generating at least one secondary air control signal, said control signal being substantially proportional to the ratio of the first fuel total chemical energy content and the total combustor energy input; and means, responsive to said secondary air control signal, for biasing the distribution of secondary air between the fuel streams, the ratio of the first fuel secondary air flow rate to the total secondary air flow rate being substantially proportional to the ratio of the first fuel total chemical energy content to the total combustor energy input.

2. The apparatus of claim 1, wherein the means for determining the total chemical energy content of the first fuel stream further comprises:

means for determining the specific chemical energy content of the first fuel;

means for determining the mass flow rate of the first fuel; and means for multiplying said first fuel specific chemical energy content and mass flow rate, whereby the first fuel stream total chemical energy content is determined.

3. The apparatus of claim 2, wherein the means for determining the specific chemical energy content of the first fuel includes means for continually measuring the fractional carbon content of the first fuel.

4. The apparatus of claim 3, wherein the means for continually measuring the fractional carbon content of the first fuel includes a prompt neutron activation analyzer.

5. The apparatus of one of claims 1, 2, 3 or 4, wherein the means for determining the total chemical energy content of the second fuel stream comprises means for determining the mass flow rate of the second fuel stream.

6. The apparatus of one of claims 1, 2, 3 or 4, wherein the means for biasing the distribution of secondary air includes at least one damper disposed in at least one secondary air stream.

7. The apparatus of claim 5, werein the means for biasing the distribution of secondary air includes at least one damper disposed in at least one secondary air flow stream.

8. In a multiple fuel combustor with a first fuel stream, a second fuel stream, a source of secondary air, and a means for biasing a flow of secondary air between a first secondary air stream and a second secondary air stream, the method for automatically controlling said biasing means, comprising the steps of:

a. determining the total chemical energy content of the first fuel stream;

b. determining the total chemical energy content of the second fuel stream;

c. summing the energy contents determined in steps a and b to provide a total combustor energy input;

d. determining the ratio of the first fuel stream total chemical energy content to the total combustor energy input;

e. adjusting said biasing means to provide a ratio of first fuel secondary air flow rate to total secondary air flow rate proportional to the ratio determined in step d.

9. The method of claim 8, wherein the step of determining to total chemical energy content of the first fuel stream includes the steps of:

measuring the specific chemical energy content of the first fuel stream;

measuring the mass flow rate of the first fuel into the combustor; and multiplying the first fuel specific chemical energy content by the first fuel flow rate, whereby the first fuel chemical energy content is established.

10. The method of claim 9, wherein the step of measuring the first fuel specific chemical energy content includes the step of determining the fractional carbon content of the first fuel.

11. The method of claim 10, wherein the step of determining the fractional carbon content of the first fuel includes the steps of:

bombarding at least a portion of the first fuel stream with neutrons to induce the emission of gamma rays; and measuring the energy level of said gamma rays to determine to carbom content of the sample fuel.

12. The method of one of claims 8, 9, 10 or 11, wherein the step of determining the total chemical energy content of the second fuel steam includes the step of measuring the mass flow rate of the second fuel into the multiple fuel combustor.

* * * * *